US005490769A

United States Patent [19]

Calhoun

[11] Patent Number: 5,490,769

[45] Date of Patent: Feb. 13, 1996

[54] VARIABLE CAPACITY SCROLL TYPE FLUID DISPLACEMENT APPARATUS

[75] Inventor: John L. Calhoun, Dallas, Tex.

[73] Assignee: Sanden International (U.S.A.), Inc., Wylie, Tex.

[21] Appl. No.: 340,460

[22] Filed: Nov. 14, 1994

Related U.S. Application Data

[63] Continuation of Ser. No. 5,387, Jan. 15, 1993, abandoned.

[51] Int. Cl.[6] ..... F01C 1/04; F01C 17/06; F01C 21/16

[52] U.S. Cl. ..... 418/1; 418/17; 418/55.3; 418/57; 418/69; 418/181

[58] Field of Search ..... 418/1, 17, 22, 418/55.1, 55.3, 57, 69, 181, 188; 417/310, 440

[56] References Cited

U.S. PATENT DOCUMENTS

| | | | |
|---|---|---|---|
| 801,183 | 6/1905 | Creux . | |
| 3,874,827 | 4/1975 | Young | 418/57 |
| 4,170,438 | 10/1979 | Kondo et al. | 417/223 |
| 4,424,010 | 1/1984 | McCullough | 417/420 |
| 4,468,178 | 8/1984 | Hiraga et al. | 417/440 |
| 4,551,078 | 11/1985 | Hiraga | 418/55.1 |
| 4,575,318 | 3/1986 | Blain | 418/188 |
| 4,756,675 | 6/1988 | Kakuda et al. | 417/338 |
| 4,998,864 | 3/1991 | Muir | 417/410 |
| 5,006,045 | 4/1991 | Shimoda et al. | 417/42 |
| 5,066,206 | 11/1991 | Kakuda et al. | 418/55.3 |
| 5,141,421 | 8/1992 | Bush et al. | 418/55.3 |
| 5,167,494 | 12/1992 | Inagagi et al. | 417/440 |

FOREIGN PATENT DOCUMENTS

| | | | |
|---|---|---|---|
| 55-096390 | 7/1980 | Japan | 418/55.3 |
| 57-198386 | 12/1982 | Japan | 417/440 |
| 58-117376 | 7/1983 | Japan | 418/69 |
| 59-12187 | 1/1984 | Japan | 418/57 |
| 2227576 | 9/1990 | Japan | 418/55.3 |
| 3134285 | 6/1991 | Japan | 418/55.1 |

*Primary Examiner*—John J. Vrablik
*Attorney, Agent, or Firm*—Baker & Botts

[57] ABSTRACT

An infinitely variable scroll-type fluid displacement apparatus comprises an orbiting scroll having a spiral element interfitted with a spiral element of a base scroll. The orbiting scroll and the base scroll are both rotatably disposed in the compressor housing and operationally connected through a rotation prevention mechanism. The orbiting scroll is continuously driven by a drive shaft, even when fluid is not displaced through the scroll-type fluid displacement apparatus. The base scroll is mounted on a carrier which has magnetic rotor elements extending in close proximity to an electromagnet. When the electromagnet is energized, an attraction force is generated between the electromagnet and the magnetic rotor elements, thereby imparting a braking force to the base scroll. Depending on the amount of braking force imparted to the base scroll, the capacity of the scroll-type fluid displacement apparatus can be infinitely varied.

55 Claims, 1 Drawing Sheet

VARIABLE CAPACITY SCROLL TYPE FLUID DISPLACEMENT APPARATUS

This is a continuation of application Ser. No. 08/005,387, filed Jan. 15, 1993, abandoned.

BACKGROUND OF THE INVENTION

1. Field of the Invention

This invention relates generally to a scroll-type fluid displacement apparatus such as a compressor or pump, and more particularly, to a scroll-type fluid displacement apparatus incorporating a variable displacement device.

2. Background of the Prior Art

Scroll type fluid displacement apparatus are well known in the prior art. For example, U.S. Pat. No. 801,182 to Creux discloses such a device which includes two scrolls each having a circular end plate and a spiroidal or involute spiral element. The scrolls are maintained angularly and radially offset so that both spiral elements interfit to make a plurality of line contacts between their spiral curved surfaces to thereby seal off and define at least one pair of fluid pockets. The relative orbital 5motion of the two scrolls shifts the line contacts along the spiral curved surfaces and, as a result, the volume of the fluid pockets changes. Since the volume of the fluid pockets increases or decreases dependent of the direction of the orbital motion, a scroll type fluid displacement apparatus may be used to compress, expand or pump fluids.

Scroll type fluid displacement apparatus are suitable for use as refrigerant compressors in air conditioners. In this application, thermal control in a room or control of the air conditioner is generally accomplished by intermittent operation of the compressor. Once the temperature in the room has been cooled to a desired temperature, the supplemental refrigerant capacity required of the air conditioner to maintain the room at the desired temperature need not be very large.

When scroll-type compressors are employed in automotive applications, the compressors are typically driven by the engine of the automobile through an electromagnetic clutch. Once the passenger compartment reaches the desired temperature, supplemental cooling is accomplished by intermittent operation of the compressor through the electromagnetic clutch. Thus, the relatively large load which is required to drive the compressor is intermittently applied to the automobile engine. However, capacity control of the air conditioning system by cycling the electromagnetic clutch on and off is not very efficient and stresses the mechanical components of the compressor.

It is, therefore, desirable to provide a scroll type compressor with a displacement or volume adjusting mechanism which controls compressor capacity as occasion demands, thus eliminating the need for intermittent operation of the compressor and the accompanying stress on the driving source and electromagnetic clutch. In a scroll type compressor, adjustment of capacity can be easily accomplished by controlling the volume of the sealed off fluid pockets. Such a capacity adjusting mechanism is disclosed, for example, in Hiraga et al., U.S. Pat. No. 4,468,178 wherein the adjusting mechanism includes a pair of holes formed through the circular end plates of the one of the scrolls. The holes are symmetrically placed so that the wrap of the other scroll simultaneously crosses over the holes. The opening and closing of the holes is controlled by valves.

In the Hiraga capacity adjusting mechanism, when the pair of holes is opened to effect a reduction in compressor capacity, fluid in the outermost fluid pockets is permitted to leak to the suction chamber through the holes. As fluid passes through the holes, there is a corresponding pressure increase in the suction chamber and a pressure loss in the outermost fluid pockets. The fluid bypass through the pair of holes is typically known in the art as a hot gas bypass.

While the hot gas bypass of partially or completely compressed fluid to a region of lower pressure reduces the capacity of the compressor, it is not without a cost. In particular, the heat generated by the fluid compression process is added to the low pressure fluid. Consequently, fluid heating is significantly increased when the bypass circuit introduces high-pressure, high-temperature fluid to the low-pressure, low-temperature fluid at the suction chamber inlet, often to an extent that mechanical failure of the pump or compressor becomes a concern.

In addition to the problems associated with bypassing fluid from high to low pressure areas in prior art scroll compressors, conventional scroll compressors, when declutched, are characterized by a backflow of compressed gas from the discharge chamber. The backflow causes the orbiting scroll member and associated drive shaft to reverse their direction of rotation. This reverse movement often generates objectionable noise or rumble. Additionally, in some situations, such as a blocked condenser fan, it is possible for the discharge pressure to increase sufficiently to stall the drive motor and effect a reverse rotation thereof. As the orbiting scroll rotates in the reverse direction, the discharge pressure will decrease to a point where the motor again is able to overcome the pressure head and rotate the scroll member in the "forward" direction. However, if the discharge pressure increases to a point where the cycle is repeated, the compressor and its associated parts may be damaged.

In addressing the backflow and subsequent counter-rotation problem, some prior art scroll type compressors introduce a one way check valve in the fluid outlet passage. The check valve prevents counter-rotation of the crankshaft immediately upon disengagement of the clutch. The check valve, however, has necessarily led to increased coolant flow resistance and a consequent reduction in coolant output by the compressor during periods of high heat load. In addition, under certain conditions, an objectionable noise is generated by the operation of the check valve.

Thus, some compressors eliminate check valves while preventing reverse rotation of the orbiting scroll during initial declutching of the compressor. For example, Muir, U.S. Pat. No. 4,998,864 employs a one-way clutch on the drive shaft. When the driving input to the compressor is terminated, any tendency for the Muir ∝864 orbiting scroll to rotate in reverse is immediately prevented by the one-way clutch. Alternatively, Shimoda et al., U.S. Pat. No. 5,006,045 incorporates a sophisticated braking system comprising an electromotor which generates eddy currents in a rotor fixedly secured to the drive shaft. The eddy currents supply a torque to the orbiting scroll which prevents the reverse rotation thereof. In each of these compressors, a separate reverse rotation protection mechanism must be provided. Thus, the cost, and often the size, of the compressor increases.

Moreover, in prior art compressors in which the drive shaft is driven by a pulley which is selectively clutched and declutched from the power source, there exists, if the compressor locked up, the possibility that the belt would shear across the pulley. In such a situation, the torque on the crankshaft suddenly increases many times beyond the normal operating torque, with the result that the power source stalls, the belt shears or the crankshaft drive mechanism fails. Thus, it is desirable to implement an inexpensive and reliable lockup control device in the event that the compressor locks up during operation.

Still further, in prior art compressors whose power is derived from a pulley having a serpentine belt winding therearound, the power is conventionally transmitted to the drive shaft by selectively engaging an electromagnetic clutch. In these conventional compressors, the pulley typically surrounds the electromagnetic coils. Consequently, the size of the pulley is increased to accommodate the electromagnetic coils. It is well known that a larger pulley rotates slower than a smaller pulley for a given linear velocity of the drive belt. Thus, all things being equal, either the power source must rotate at a faster speed or the displacement of the compressor must be increased in order to deliver the same refrigerant output as a pulley with a smaller diameter.

These and other disadvantages are addressed by the compressor according to the preferred embodiment which is described in more particularity below.

SUMMARY OF THE INVENTION

It is an object of the preferred embodiment to provide a scroll type pump or compressor with a mechanism for varying its pumping capacity without bypassing high pressure fluid to the low pressure side of the compressor.

It is a further object of the preferred embodiment to provide a pump or compressor which does not require a check valve in the fluid outlet passage or an elaborate system to prevent objectionable counter-rotation of the drive shaft when pumping or compressing is stopped.

It is another object of the preferred embodiment to reduce or eliminate the shock to the drive mechanism if the scrolls become locked due to mechanical failure.

It is a further object of the preferred embodiment to provide a pump or compressor which can utilize a smaller drive pulley than is used in current practice thereby permitting very high-speed operation and a consequent reduction in compressor size without alteration of the power source.

These and other objects and features are provided by a scroll type compressor comprising an orbiting scroll and a base scroll having respective end plates and spiral elements extending therefrom. The spiral elements of the orbiting scroll and the spiral element of the base scroll interfit to form a plurality of fluid pockets in which fluid is compressed. The base scroll is fixedly secured to a carrier. The carrier is rotatably mounted in the housing and has an infinitely variable braking force applied thereto to generate relative orbital motion between the fixed scroll and the base scroll. The carrier according to the preferred embodiment includes an end plate, magnetic rotor elements extending from one surface of the end plate, and an annulus extending from the other surface of the end plate. The base scroll and the orbiting scroll are operationally connected together through a rotation prevention mechanism.

A braking device applies a braking force to the base scroll so that the orbiting scroll develops relative orbital motion with respect to the base scroll. More particularly, the braking device according to the preferred embodiment includes an annular electromagnet fixedly disposed in the housing in close proximity to the magnetic rotor elements. When the electromagnet is energized, an attraction force is generated between the electromagnet and the rotor elements on the carrier. The attraction force tends to retard the rotation of the carrier to which the base scroll is mounted. Accordingly, the orbiting scroll begins to move with relative orbital motion with respect to the base scroll.

Depending on the amount that the electromagnet is energized, the relative orbital motion between the orbiting scroll and the base scroll is varied. Accordingly, the capacity of the scroll-type fluid displacement apparatus depends on the amount of relative orbital motion between the base scroll and the orbiting scroll which in turn depends on the amount of braking imparted to the rotor elements of the carrier.

The scroll-type fluid displacement apparatus according to the preferred embodiment, in contrast to the conventional scroll compressors, does not vary its capacity with a hot-gas bypass. Instead, a braking device is relied upon to vary the capacity. In addition, the capacity can be infinitely varied from negligible to maximum without large step increments in the amount of variation.

Also, since the drive shaft is continuously driven even when there is no fluid being displaced within the apparatus, the drive shaft does not rotate in reverse upon the termination of compression. Consequently, there is no need for check valves in the fluid outlet passage or elaborate one-way clutches or control systems designed to impart a braking force to the orbiting scroll when compression has ended. In addition, since the drive shaft is continuously driven, there is no need for the electromagnetic clutch traditionally provided within the pulley. Thus, the diameter of the pulley can be smaller, leading to greater rotational speed thereof for a given linear velocity of the serpentine belt.

The scroll-type fluid displacement apparatus according to the preferred embodiment also reduces the likelihood of shearing a serpentine belt or, if a hermetic scroll is provided, overheating the motor, since both scrolls are rotatably mounted in the compressor housing. If the scrolls lock-up in operation, they simply continue to rotate even though they cannot compress or expand the working fluid. However, in the conventional scroll-type fluid displacement apparatus, locking scrolls generate an extreme torque on the drive shaft and the increased likelihood that the serpentine belt will shear. The preferred embodiment avoids the traditional problems associated with scroll lockup by rotatably disposing both scrolls within the housing.

Further objects, features and other aspects of the preferred embodiment will be understood from the detailed description with reference to the drawing.

DETAILED DESCRIPTION OF THE PREFERRED EMBODIMENT

Figure 1:
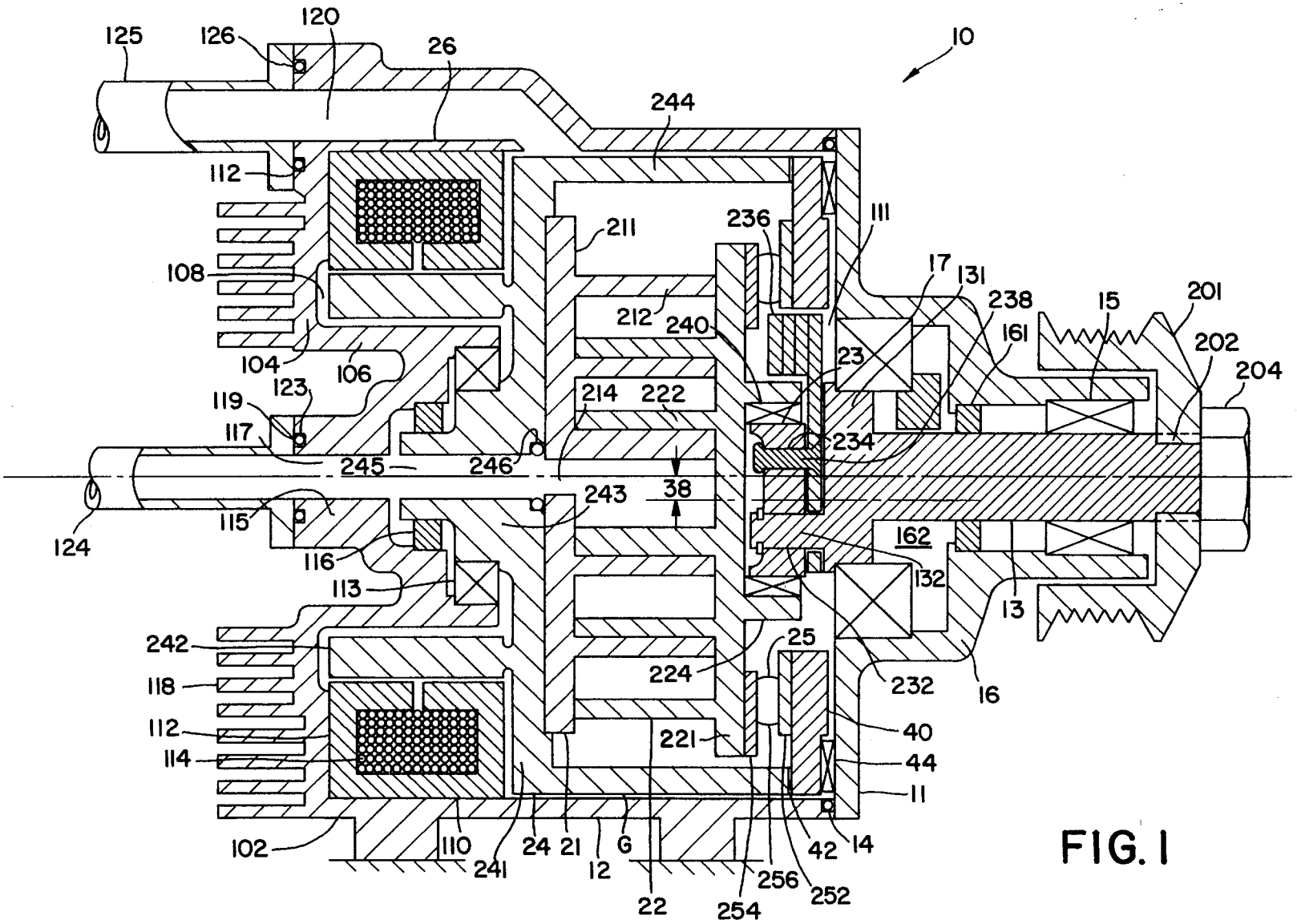
FIG. 1 is a cross section of the infinitely variable scroll-type fluid displacement apparatus according to the preferred embodiment.

Without limiting the claimed invention, and for purposes of description only, the right side of the compressor as shown in FIG. 1 is described as the front or forward portion while the left side of the compressor as shown in FIG. 1 is described as the rear or rearward portion thereof.

With reference to FIG. 1, there is shown a scroll-type fluid displacement apparatus 10 according to the 5preferred embodiment. The scroll-type fluid displacement apparatus 10 includes a housing comprising a front end plate 11 and a generally annular casing 12 which is attached to an end surface of front end plate 11. When the scroll-type fluid displacement apparatus is used in connection with automotive applications, annular casing 12 is preferably fixedly mounted to the interior of an automobile engine compartment in accordance with any known mounting technique readily known to those skilled in the art. A seal 14 is placed between casing 12 and front end plate 11 to seal the mating surfaces therebetween. An opening 111 is formed in the center of front end plate 11.

An annular sleeve 16 longitudinally projects from a front end surface of front end plate 11. A drive shaft 13 extends within annular sleeve 16. A seal element 161 is provided between the mating surfaces of drive shaft 13 and annular sleeve 16, and a shaft seal cavity 162 is defined to the rear of seal 161 within annular sleeve 16. The forward end of drive shaft 13 is rotatably supported by annular sleeve 16 through bearing 15 located within the front end of sleeve 16. The rearward end of drive shaft 13 has a disk-shaped rotor 131 which is rotatably supported by front end plate 11 through a bearing 17 located within opening 111.

A pulley 201 is permanently and fixedly connected to the end of drive shaft 13 by splines 202 and secured thereto by nut 204. Other means for securing the pulley will become readily apparent to those skilled in the art. In operation, drive shaft 13 is continuously driven by an external power source, for example, the engine of an automobile. However, it is within the scope of the preferred embodiment to provide a conventional electromagnetic clutch mechanism surrounding sleeve 16. Alternatively, scroll-type fluid displacement apparatus 10 could be of the hermetic type in which the rotational power is provided by an electromagnet and armature as is well known to those skilled in the art.

A base scroll 21, an orbiting scroll 22 and a rotation prevention/thrust bearing mechanism 25 for orbiting scroll 22 are disposed in the interior of housing 12.

Orbiting scroll 22 includes a circular end plate 221 and a spiral element 222 extending from one end surface of circular end plate 221. An annular boss 224 extends from the other end of circular end plate 221. Orbiting scroll 22 is rotatably supported by a bushing 23, which is eccentrically connected to the inner end of disc-shaped rotor 131. Bushing 23 is rotatably disposed within annular boss 224 through radial needle bearings 240. Bushing 23 has a hole 232 formed therein which is offset from the center line of drive shaft 13. A crank pin 132 extends from the rear end of disc-shaped rotor 131 and is offset from the centerline of the drive shaft 13. Crank pin 132 is secured within hole 232. Also, bushing 23 has a hole 234 formed therein. A counter weight 236 extends outside of annular boss 224 and is connected to eccentric bushing 23 through a plurality of rivets 238 extending through hole 234. While the drive mechanism has been disclosed with respect to an offset crank pin 132, it will be understood by those skilled in the art that other equivalent drive mechanisms can readily be substituted for the disclosed drive mechanism. In particular, any drive mechanism capable of generating orbital motion could be substituted for the disclosed drive mechanism.

Base scroll 21 includes a circular end plate 211 and spiral element 212 extending from one end surface of circular end plate 211. Spiral element 222 of orbiting scroll 22 and spiral element of fixed scroll 21 interfit at an angular offset of approximately 180° and a predetermined radial offset 38, forming sealed spaces between spiral elements 212, 222. On its rearward side, base scroll 21 is fixedly secured to a carrier 24.

Carrier 24 comprises an end plate 241, rearwardly extending rotor elements 242 at a generally radially middle portion of end plate 241, a rearwardly extending boss 243 at an inner radial portion of end plate 241, and a forwardly extending annulus 244 integral with and depending from the outer radial portion of end plate 241. Annulus 244 is generally concentric with housing 12 with a gap G therebetween. A seal 246 seals the mating surfaces between end plate 24 1 and end plate 211.

At its forward end, annulus 244 is drivingly connected to a coupling support ring 40. Annulus 244 and coupling support ring 40 are joined by a plurality of bolts (not shown), or by any other securing device well known to those skilled in the art. Shims 42 are preferably placed between annulus 244 and coupling support ring 40 to eliminate any clearance therebetween. Coupling support ring 40, to which carrier 24 is drivingly connected, is rotatably supported by front end plate 11 via thrust bearings 44.

The motion of orbiting scroll 22 with respect to base scroll 21 is controlled by a rotation prevention/thrust bearing mechanism 25 located between the rear end surface of coupling support ring 40 and front end surface of circular end plate 221 of orbiting scroll 22. Rotation prevention/thrust bearing mechanism 25 comprises a base ring 252, an orbiting ring 254 and a plurality of ball elements 256. Base ring 252 is fixedly secured to coupling support ring 40 and has a plurality of circular holes (not shown) therein. Orbiting ring 254 is fixedly secured to the outer radial edge of circular end plate 221 and has a plurality of circular holes (not shown) therein. A plurality of ball elements 256 are disposed in the holes of base ring 252 and the holes of orbiting ring 254. Each ball 256 is placed between one hole of base ring 252 and one hole of orbiting ring 254, and moves along the edges of holes, allowing orbital motion of orbiting scroll 22 but at least partially preventing rotation when, as described below, current is supplied to braking mechanism 26. Also, the thrust axial load from orbiting scroll 22 is borne in part by front end plate 11 through balls 256. While the preferred embodiment has been disclosed with respect to a thrust ball-type coupling, those skilled in the art will readily recognize that any equivalent coupling which permits relative orbital motion between base scroll 21 and orbiting scroll 22 could easily be substituted for the rotation prevention/thrust bearing mechanism 25.

At its rear end, the compressor housing comprises an outer cylindrical portion 102, a rear end plate portion 104 and an inner cylindrical portion 106. An annular hollow portion 108 is formed between outer cylindrical portion 102 and inner cylindrical portion 106. A substantially annular electromagnet 110 is fixedly disposed in the hollow portion 108. Electromagnet 110 comprises an annular magnetic housing 112 and an annular electromagnetic field coil 114 contained therein. A substantially annular sleeve 115 extends rearwardly from an inner surface of inner cylindrical portion 106. However, depending on the configuration of the port area, sleeve 115 can assume many configurations which are not essential to the preferred embodiment.

Rotor elements 242, extending rearwardly from carrier 24, are positioned in hollow portion 108 between inner cylindrical portion 106 and magnetic housing 112. Carrier 24 is rotatably supported in casing 12 through bearings 113 disposed between boss 243 and inner cylindrical portion 106. A seal 116 seals the mating surfaces between boss 243 and annular sleeve 115. Fins 118 extend rearwardly from rear end plate 104.

Circular end plate 211 has a discharge hole 214 formed therein. Boss 243 has a hollow central communication path 245 in fluid communication with discharge hole 214. In addition, annular sleeve 115 has a hollow central communication path 117 in fluid communication with fluid path 245. Rear end plate portion 104 has a depression 119 on the rear end of sleeve 115. A seal 123 is placed in depression 119 to seal the mating surfaces of the rear end plate 104 and the other elements, e.g., an outlet pipe 124, of a refrigerant circuit. In the event that the scroll-type fluid displacement apparatus operates as a compressor, compressed refrigerant exits the innermost fluid pocket through discharge hole 214 and flows through fluid flow passages 245 and 117.

A fluid inlet passage 120 is disposed radially outside a portion of outer cylindrical portion 102 of the compressor housing. A seal 126 is placed in depression 122 to seal the mating surfaces of the rear end plate 104 and the other elements, e.g., an inlet pipe 125, of a refrigerant circuit. The flow of refrigerant from fluid inlet 120 to the outermost fluid pocket serves to lubricate thrust bearings 44 and rotation prevention mechanism 25. In particular, during compression, refrigerant from inlet pipe 125 flows to the interior of the compressor 10 through fluid inlet 120, along gap G between annulus 244 and the inner surface of annular casing 12, through thrust bearing 44, between the forward end of support ring 40 and rear side of front end plate 11, through rotation prevention mechanism 25 and finally to the outermost fluid pocket. If the scroll-type fluid displacement apparatus 10 operated as a pump to expand the working fluid, the flow of fluid would be in the reverse direction. In addition, holes may be provided in annulus 244 to reduce the flow restriction which may be encountered with gap G. In this alternate embodiment, some of the working fluid would follow the flow path through the rotation prevention/thrust bearing mechanism 25 while the remainder of the fluid would bypass the rotation prevention/thrust bearing mechanism 25 by flowing through the unshown holes in annulus 244.

As discussed above, carrier 24 is rotatably supported by bearings 113 and bearings 44. Thus, when the compressor is not in operation, carrier 24 and base scroll 21 rotate with orbiting scroll 22. However, when the compressor is in operation, base scroll 21 and orbiting scroll 22 are controlled to have relative orbital motion therebetween. In particular, depending upon the amount of compression required, carrier 24 and base scroll 21 are partially or totally braked by braking mechanism 26, thereby generating relative orbital motion between base scroll 21 and orbiting scroll 22.

In the compressor according to the preferred embodiment, braking mechanism 26 comprises electromagnet 110 and rotor elements 242. The field coils 114 of the electromagnet 110 are energized by the application of electric current. The magnetic field in coils 114 induces eddy currents in rotor elements 242, which are preferably manufactured from a magnetic material. The eddy currents induced in rotor elements 242 generate a magnetic field opposite to that in field coils 114, tending to attract rotor elements 242 to the poles of the magnetic field in field coils 114. The attraction generates a torque which tends to retard the rotation of carrier 24 and base scroll 21 with respect to housing 12. Thus, the amount of current supplied to the field coils 114 determines the extent to which carrier 24 is braked.

The compressor's pumping capacity is a function of the speed of the orbital motion of orbiting scroll 22 with respect to base scroll 21. Increased braking, therefore, increases pumping capacity and vice versa. For example, as the rotational speed of carrier 24 and base scroll 21 with respect to 2housing 12 is reduced through braking, the rotational speed of drive shaft 13 with respect to base scroll 21 increases. Consequently, the orbital speed of orbiting scroll 22 with respect to base scroll 21 increases, and the compressor's capacity is increased.

Alternatively, as the rotational speed of carrier 24 and base scroll 21 with respect to housing 12 is increased through a reduction in braking, the rotational speed of drive shaft 13 with respect to base scroll 21 decreases. Consequently, the orbital speed of orbiting scroll 22 with respect to base scroll 21 decreases, and the compressor's capacity is decreased. If no retarding torque is applied at all, base scroll 21 rotates at the same speed as drive shaft 13, and no relative orbital motion or compression occurs. The operation of the speed varying device can be controlled by any desired combination of system parameters, e.g., suction chamber pressure, passenger compartment temperature, etc. Heat generated by the slippage of braking mechanism 26 is dissipated by cooling fins 118. However, other well known heat dissipation devices, e.g. a cooling fan, could be used.

The compressor according to the preferred embodiment provides an infinitely variable control system for varying the compressor's capacity. Accordingly, capacity control can be effected much more precisely than compressors relying on hot-gas bypass. In addition, the preferred embodiment avoids some of the deleterious effects associated with conventional capacity control, e.g., excessive heating of the refrigerant during capacity control.

The preferred embodiment has been described with reference to a base scroll 21 which rotates with orbiting scroll 22 without relative orbital motion therebetween when carrier 24 is not braked. However, it is within the scope of the preferred embodiment to provide a conventional electromagnetic clutch around sleeve 16 such that, upon disengagement of the clutch, pulley 201 freewheels without driving compressor 10. This alternative embodiment enjoys the benefits of infinitely variable capacity control while also minimizing the power supplied to automobile subsystems such as an air conditioning compressor which is not in use.

While the preferred embodiment discloses an electromagnet to generate a retarding torque, it is within the scope of the preferred embodiment to employ braking devices other than an electromagnet. For example, such braking devices could include mechanical braking devices, hydraulic braking devices, pneumatic braking devices, electrical braking devices, etc., as are well known to those skilled in the art. The eddy current braking device of the preferred embodiment is only an illustration of one of many standard devices which may be used to achieve the braking effect.

The preferred embodiment provides a smooth, stepless variable control system for varying the pumping or compression capacity of a scroll-type fluid displacement apparatus. Thus, it is not necessary, when capacity control is desired, to bypass high pressure, high temperature fluid into the low pressure, low temperature fluid. Consequently, less heat is generated while compressing the refrigerant, which allows for more heat absorption through the evaporator. In addition, the likelihood of mechanical failure of the pump or compressor due to overheating has been reduced, since the working fluid will not be heated in a hot gas bypass operation.

The compressor according to the preferred embodiment provides the additional advantage of reducing the damage to the drive shaft or power source, e.g., a serpentine belt, in the event of compressor lockup. In conventional compressors, when the orbiting scroll becomes locked with the fixed scroll due to, e.g., a jammed rotation prevention/thrust bearing mechanism, the rotational speed of the orbiting scroll is reduced to nearly zero. Consequently, .with the fixed scroll secured to the housing, the torque on the drive shaft increases many times beyond that which would be experienced when the compressor is operating at maximum capacity.

In the compressor according to the preferred embodiment, on the other hand, base scroll 21 and orbiting scroll 22 are interfitted through carrier 24. Thus, if compressor 10 fails due to, e.g., a jammed rotation prevention/thrust bearing mechanism 25, the braking device's holding torque is equal and opposite to the reaction torque developed on base scroll 21 by the action of compressing. Thus, the torque on drive shaft 13 would merely double, as opposed to increasing many times beyond the maximum operating capacity as in the prior art. Consequently, drive shaft 13 would continue to rotate and the serpentine belt would not shear across pulley 201.

In addition, when the braking device 26 is completely disengaged, the high pressure fluid flowing in reverse through the communication path 117, 245 accelerates the base scroll 21 to match the drive shaft's 13 rotational speed and stop the orbiting motion with respect to orbiting scroll 22. Since drive shaft 13 is never declutched, the traditionally objectionable reverse rotation of the drive shaft is eliminated. Thus, no check valve is required in outlet passages 117, 245, thereby reducing the complexity of the assembly and eliminating any undesirable discharge pulsations or increased fluid flow resistance.

Still further, since the compressor according to the preferred embodiment does not require a nested field coil inside drive pulley 201, the pulley size may be reduced. Consequently, drive shaft 13 turns at a higher rotational speed for a given linear velocity of the belt. This leads to a corresponding reduction in the pump or compressor size without alteration of the external power source.

While this invention has been described in connection with the preferred embodiment, this embodiment is merely for example only, and the invention is not restricted thereto. It will be readily apparent to those skilled in the art that changes and modifications can easily be made without departing from the scope of the invention as defined by the claims.

I claim:

1. A scroll-type fluid displacement apparatus comprising:

a housing having a fluid inlet port and a fluid outlet port;

a first scroll disposed within said housing and having an end plate from which a first spiral wrap extends into the interior of said housing;

a second scroll having an end plate from which a second spiral wrap extends, said first and second wraps interfitting at an angular and radial offset to form a plurality of line contacts which define at least one pair of sealed off fluid pockets;

a driving mechanism operatively coupled to one of said first or second scrolls to effect relative orbital motion between said scrolls;

means for mounting said one of said scrolls for orbital and rotational motion with respect to said housing; and coupling means for coupling said scrolls at a fixed, continuous radial and axial offset, wherein said first scroll is operatively coupled through said coupling means for rotation with said second scroll.

2. The scroll-type fluid displacement apparatus of claim 1 timber comprising means for terminating fluid displacement while said one of said first and second scrolls is continuously driven by said driving mechanism.

3. A scroll-type fluid displacement apparatus comprising:

a housing having a fluid inlet port and a fluid outlet port through which fluid is discharged;

a base scroll disposed within said housing and having an end plate from which a first spiral wrap extends into the interior of said housing;

an orbiting scroll having an end plate from which a second spiral wrap extends, said first and second wraps interfitting at an angular and radial offset to form a plurality of line contacts which define at least one pair of sealed off fluid pockets;

means for mounting said orbiting scroll for orbital and rotational motion with respect to said housing;

a driving mechanism operatively coupled to said orbiting scroll to effect relative orbital motion between said orbiting scroll and said base scroll; and coupling means for coupling said base scroll to said orbiting scroll at a fixed, continuous radial offset, wherein said base scroll is operatively coupled through said coupling means for rotation with said orbiting scroll.

4. The scroll-type fluid displacement apparatus of claim 3, further comprising an infinitely variable capacity adjustment means operatively associated with said base scroll for infinitely varying the capacity of said base and orbiting scrolls to compress or expand the fluid in said fluid pockets.

5. The scroll-type fluid displacement apparatus of claim 4, said infinitely variable capacity adjusting means comprising a braking means for applying a braking force to said base scroll.

6. The scroll-type fluid displacement apparatus of claim 5, wherein as the braking force applied to said base scroll increases, the amount of relative orbital motion between said orbiting scroll and said base scroll increases to thereby increase the capacity of said base and orbiting scrolls to compress or expand the fluid in said fluid pockets.

7. The scroll-type fluid displacement apparatus of claim 5, wherein as the braking force applied to said base scroll decreases, the amount of relative orbital motion between said orbiting scroll and said base scroll decreases to thereby decrease the capacity of said base and orbiting scrolls to compress or expand the fluid in said fluid pockets.

8. The scroll-type fluid displacement apparatus of claim 5, said braking means causing said orbiting scroll to orbit with respect to said base scroll.

9. The scroll-type fluid displacement apparatus of claim 5, further comprising a carrier rotatably mounted in said housing, said carrier comprising an end plate, magnetic rotor elements extending from one side of said end plate and an annulus extending from another side of said end plate, said base scroll mounted on said carrier for rotation therewith.

10. The scroll-type fluid displacement apparatus of claim 9, said carrier and said orbiting scroll operatively connected through a rotation prevention mechanism.

11. The scroll-type fluid displacement apparatus of claim 9, further comprising an electromagnet mounted in said housing, said braking means comprising said magnetic rotor elements and said electromagnet.

12. The scroll-type fluid displacement apparatus of claim 3, further comprising a pulley fixedly secured to said drive shaft, said pulley continuously supplying rotational power to said drive shaft even when fluid is not displaced through said scroll-type fluid displacement apparatus.

13. The scroll-type fluid displacement apparatus of claim 3 further comprising means for terminating fluid displacement while said orbiting scroll is continuously driven by said driving mechanism.

14. A scroll-type fluid displacement apparatus comprising:

a housing having a fluid inlet port and a fluid outlet port;

a first scroll disposed within said housing and having an end plate from which a first spiral wrap extends into the interior of said housing;

a second scroll having an end plate from which a second spiral wrap extends, said first and second wraps interfitting at an angular and radial offset to form a plurality of line contacts which define at least one pair of sealed off fluid pockets;

a driving mechanism operatively coupled to one of said first or second scrolls to impart a rotational driving force to said one of said first or second scrolls and to effect relative orbital motion between said scrolls; and coupling means for coupling said scrolls at a fixed, continuous radial offset, wherein said first scroll is operatively coupled through said coupling means for rotation with said second scroll, and wherein said first and second scrolls rotate with a variable rotational velocity.

15. The scroll-type fluid displacement apparatus according to claim 14, further comprising a braking means, associated with the other of said one of said first and second scrolls, for applying a braking force to cause said first and second scrolls to rotate with a variable rotational velocity varying between zero and the input speed of said driving mechanism.

16. A scroll-type fluid displacement apparatus comprising:

a housing having a fluid inlet port and a fluid outlet port through which fluid is discharged;

a base scroll disposed within said housing and having an end plate from which a first spiral wrap extends into the interior of said housing;

an orbiting scroll having an end plate from which a second spiral wrap extends, said first and second wraps interfitting at an angular and radial offset to form a plurality of line contacts which define at least one pair of sealed off fluid pockets;

a driving mechanism operatively coupled to said orbiting scroll to effect the orbital motion of said orbiting scroll, said driving mechanism operatively driving said orbiting scroll at an input speed;

a rotation prevention means for allowing said orbiting scroll to orbit with respect to said base scroll while preventing said orbiting scroll from rotating with respect to said base scroll whereby the volume of the fluid pockets changes during orbital motion to compress or expand the fluid in said pockets; and an infinitely variable capacity adjustment means operatively associated with said base scroll for infinitely varying the capacity of said base and orbiting scrolls to compress or expand the fluid in said fluid pockets while substantially maintaining the input speed of said driving mechanism.

17. The scroll-type fluid displacement apparatus of claim 16, said base scroll rotatably mounted in said housing, said infinitely variable capacity adjustment means comprising a braking means for applying a braking force to said base scroll.

18. The scroll-type fluid displacement apparatus of claim 17, wherein as the braking force applied to said base scroll increases, the amount of relative orbital motion between said orbiting scroll and said base scroll increases to thereby increase the capacity of said base and orbiting scrolls to compress or expand the fluid in said fluid pockets.

19. The scroll-type fluid displacement apparatus of claim 17, wherein as the braking force applied to said base scroll decreases, the amount of relative orbital motion between said orbiting scroll and said base scroll decreases to thereby decrease the capacity of said base and orbiting scrolls to compress or expand the fluid in said fluid pockets.

20. The scroll-type fluid displacement apparatus of claim 17, further comprising a carrier, said end plate of said base scroll mounted on said carrier.

21. The scroll-type fluid displacement apparatus of claim 20, said carrier comprising an end plate, rotor elements depending from one side of said end plate and an annulus extending from another side of said end plate, said annulus operatively coupled to said orbiting scroll through said rotation prevention mechanism.

22. The scroll-type fluid displacement apparatus of claim 6, further comprising an electromagnet disposed in said housing, and wherein said rotor elements comprise magnetic rotor elements and said braking means comprises said electromagnet and said magnetic rotor elements.

23. The scroll-type fluid displacement apparatus of claim 17, said base scroll and said orbiting scroll having no relative orbital motion therebetween when said braking means does not apply a braking force to said base scroll.

24. The scroll-type fluid displacement apparatus of claim 17, said base scroll and said orbiting scroll having relative orbital motion therebetween when said braking means applies a braking force to said base scroll.

25. The scroll-type fluid displacement apparatus of claim 24, wherein as the braking force applied to said base scroll increases, the amount of relative orbital motion between said orbiting scroll and said base scroll increases to thereby increase the capacity of said base and orbiting scrolls to compress or expand the fluid in said fluid pockets.

26. The scroll-type fluid displacement apparatus of claim 24, wherein as the braking force applied to said base scroll decreases, the amount of relative orbital motion between said orbiting scroll and said base scroll decreases to thereby decrease the capacity of said base and orbiting scroll to compress or expand the fluid in said fluid pockets.

27. The scroll-type fluid displacement apparatus of claim 16, further comprising a carrier rotatably disposed in said housing, said base scroll mounted on said carrier.

28. The scroll-type fluid displacement apparatus of claim 27, said end plate of said base scroll mounted on said carrier.

29. The scroll-type fluid displacement apparatus of claim 27, said carrier operatively coupled to said orbiting scroll.

30. The scroll-type fluid displacement apparatus of claim 29, said rotation prevention mechanism operatively coupling said carrier and said orbiting scroll.

31. The scroll-type fluid displacement apparatus of claim 27, said rotation prevention mechanism operatively coupling said carrier and said orbiting scroll.

32. The scroll-type fluid displacement apparatus of claim 27, said carrier further comprising an end plate and an annulus depending from said end plate.

33. The scroll-type fluid displacement apparatus of claim 32, further comprising an electromagnet disposed in said housing.

34. The scroll-type fluid displacement apparatus of claim 33, said carrier further comprising magnetic rotor elements extending from said carrier, said infinitely variable capacity adjustment means comprising said magnetic rotor elements and said electromagnet.

35. The scroll-type fluid displacement apparatus of claim 32, said rotation prevention mechanism operatively coupling said annulus and said orbiting scroll.

36. The scroll-type fluid displacement apparatus of claim 16, said rotation prevention means operatively coupling said orbiting scroll and said base scroll, and wherein both said orbiting scroll and said base scroll are rotatably mounted in said housing.

37. The scroll-type fluid displacement apparatus of claim 36, said infinitely variable capacity adjustment means comprising a braking means for applying a braking force to said base scroll.

38. The scroll-type fluid displacement apparatus of claim 16, wherein said scroll-type fluid displacement apparatus comprises a compressor.

39. The scroll-type fluid displacement apparatus of claim 16, said infinitely variable capacity adjustment means adjusting the relative speed of orbital motion between said base scroll and said orbiting scroll to thereby infinitely adjust the capacity of said base and orbiting scrolls to compress or expand the fluid in said fluid pockets.

40. The scroll-type fluid displacement apparatus of claim 39, said base scroll rotatably mounted in said housing and said infinitely variable capacity adjustment means comprising a braking means for applying a braking force to said base scroll.

41. The scroll-type fluid displacement apparatus of claim 40, wherein the amount of fluid discharged from said fluid outlet port increases as the braking means applies a larger braking force to said base scroll.

42. The scroll-type fluid displacement apparatus of claim 16, said infinitely variable capacity adjustment means varies the amount of fluid discharged from said fluid outlet port by varying the relative orbital speed of said orbiting scroll with respect to said base scroll.

43. The scroll-type fluid displacement apparatus of claim 42, said base scroll rotatably mounted in said housing and said capacity adjustment means comprising a braking means for applying a braking force to said base scroll.

44. The scroll-type fluid displacement apparatus of claim 43, wherein as the braking force applied to said base scroll increases, the amount of relative orbital motion between said orbiting scroll and said base scroll increases to thereby increase the capacity of said base and orbiting scrolls to compress or expand the fluid in said fluid pockets.

45. The scroll-type fluid displacement apparatus of claim 43, wherein as the braking force applied to said base scroll decreases, the amount of relative orbital motion between said orbiting scroll and said base scroll decreases to thereby decrease the capacity of said base and orbiting scrolls to compress or expand the fluid in said fluid pockets.

46. A scroll-type fluid displacement apparatus comprising:

a housing having a fluid inlet port and a fluid outlet port through which fluid is discharged;

a base scroll disposed within said housing and having an end plate from which a first spiral wrap extends into the interior of said housing;

an orbiting scroll having an end plate from which a second spiral wrap extends, said first and second wraps interfitting at an angular and radial offset to form a plurality of line contacts which define at least one pair of sealed off fluid pockets;

a driving mechanism operatively coupled to said orbiting scroll to effect the orbital motion of said orbiting scroll, said driving mechanism operatively driving said orbiting scroll at an input speed;

a rotation prevention means for allowing said orbiting scroll to orbit with respect to said base scroll with relative orbital speed therebetween while preventing said orbiting scroll from rotating with respect to said base scroll whereby the volume of the fluid pockets changes during relative orbital motion to compress or expand the fluid in said pockets; and orbital motion varying means operatively associated with said base scroll for varying the relative orbital speed between said orbiting scroll and said base scroll while substantially maintaining the input speed of said driving mechanism.

47. A scroll-type fluid displacement apparatus comprising:

a housing having a fluid inlet port and a fluid outlet port through which fluid is discharged;

a base scroll disposed within said housing and having an end plate from which a first spiral wrap extends into the interior of said housing;

an orbiting scroll having an end plate from which a second spiral wrap extends, said first and second wraps interfitting at an angular and radial offset to form a plurality of line contacts which define at least one pair of sealed off fluid pockets;

a driving mechanism operatively coupled to said orbiting scroll to effect the orbital motion of said orbiting scroll;

a rotation prevention means for allowing said orbiting scroll to orbit with respect to said base scroll with relative orbital speed therebetween while preventing said orbiting scroll from rotating with respect to said base scroll whereby the volume of the fluid pockets changes during relative orbital motion to compress or expand the fluid in said pockets; and orbital motion varying means operatively associated with said base scroll for varying the relative orbital speed between said orbiting scroll and said base scroll; wherein said base scroll is rotatably mounted in said housing, and said orbital motion varying means comprises a braking means, operatively coupled to said base scroll, for applying a braking force to said base scroll.

48. The scroll-type fluid displacement apparatus of claim 47, wherein as the braking force applied to said base scroll increases, the relative orbital speed between said orbiting scroll and said base scroll increases to thereby increase the capacity of said base and orbiting scrolls to compress or expand the fluid in said fluid pockets.

49. The scroll-type fluid displacement apparatus of claim 47, wherein as the braking force applied to said base scroll decreases, the relative orbital speed between said orbiting scroll and said base scroll decreases to thereby decrease the capacity of said base and orbiting scrolls to compress or expand the fluid in said fluid pockets.

50. A scroll-type fluid displacement apparatus comprising:

a housing having a fluid inlet port and a fluid outlet port through which fluid is discharged;

a base scroll rotatably mounted in said housing and having an end plate from which a first spiral wrap extends into the interior of said housing;

an orbiting scroll having an end plate from which a second spiral wrap extends, said first and second wraps interfitting at an angular and radial offset to form a plurality of line contacts which define at least one pair of sealed off fluid pockets;

a driving mechanism operatively coupled to said orbiting scroll to effect the orbital motion of said orbiting scroll;

a rotation prevention means for allowing said orbiting scroll to orbit with respect to said base scroll while preventing said orbiting scroll from rotating with respect to said base scroll whereby the volume of the fluid pockets changes during orbital motion to compress or expand the fluid in said pockets; and an infinitely variable capacity adjustment means for infinitely varying the capacity of said base and orbiting scrolls to compress or expand the fluid in said fluid pockets, said infinitely variable capacity adjustment means comprising a braking means for applying a braking force to said base scroll.

51. A method of displacing fluid in a scroll-type fluid displacement apparatus, said apparatus comprising a housing having a fluid inlet port and a fluid outlet port through which fluid is discharged, a first scroll disposed within said housing and having an end plate from which a first spiral wrap extends into the interior of said housing, a second scroll having an end plate from which a second spiral wrap extends, said first and second wraps interfitting at an angular and radial offset to form a plurality of line contacts which define at least one pair of sealed off fluid pockets, a driving mechanism operatively coupled to one of said first or second scrolls, said method comprising the steps of:

driving one of said first or second scrolls with said driving mechanism at a certain input speed to effect orbital motion between said scrolls;

preventing relative rotation between said first and second scrolls while allowing said first and second scrolls to have relative orbital motion therebetween; and infinitely varying the capacity of said first and second scrolls to compress or expand the fluid in said fluid pockets by controlling the amount of relative orbital motion between said first and second scrolls while substantially maintaining the input speed of said driving mechanism.

52. The method of claim 51, the other of said first or second scrolls not driven by said driving mechanism rotatably mounted in said housing, said method further comprising the step of applying a braking force to said other of said first and second scrolls not driven by said driving mechanism to generate relative orbital motion between said first and second scrolls.

53. The method of claim 51, said apparatus further comprising a carrier rotatably mounted in said housing and an electromagnet fixedly disposed in said housing, said carrier comprising an end plate and magnetic rotor elements extending from said end plate in close proximity to said electromagnet and said first scroll coupled to said carrier for rotation therewith, said method further comprising the step of:

applying a braking force to said first scroll to generate relative orbital motion between said first scroll and second scroll.

54. The method of claim 53, further comprising the step of energizing said electromagnet to create an attractive force between said rotor elements and said electromagnet thereby increasing the relative orbital speed of said second scroll with respect to said first scroll.

55. A method of displacing fluid in a scroll-type fluid displacement apparatus, said apparatus comprising a housing having a fluid inlet port and a fluid outlet port through which fluid is discharged, a first scroll disposed within said housing and having an end plate from which a first spiral wrap extends into the interior of said housing, a second scroll having an end plate from which a second spiral wrap extends, said first and second wraps interfitting at an angular and radial offset to form a plurality of line contacts which define at least one pair of sealed off fluid pockets, at least one of said first and second scrolls rotatably mounted in said housing, a driving mechanism operatively coupled to one of said first or second scrolls, said method comprising the steps of:

driving one of said first or second scrolls with said driving mechanism to effect orbital motion between said scrolls;

preventing relative rotation between said first and second scrolls while allowing said first and second scrolls to have relative orbital motion therebetween;

infinitely varying the capacity of said first and second scrolls to compress or expand the fluid in said fluid pockets by controlling the amount of relative orbital motion between said first and second scrolls; and applying a braking force to the other of said first and second scrolls not driven by said driving mechanism to generate relative orbital motion between said first and second scrolls.

* * * * *